US012203711B2

(12) United States Patent
Tanimoto et al.

(10) Patent No.: US 12,203,711 B2
(45) Date of Patent: Jan. 21, 2025

(54) HEAT EXCHANGER CORE

(71) Applicant: MITSUBISHI HEAVY INDUSTRIES, LTD., Tokyo (JP)

(72) Inventors: Koichi Tanimoto, Tokyo (JP); Nobuhide Hara, Tokyo (JP); Hiroyuki Nakaharai, Tokyo (JP); Yoichi Uefuji, Tokyo (JP); Takuo Oda, Tokyo (JP); Shunsaku Eguchi, Tokyo (JP); Masaya Hatanaka, Tokyo (JP); Tatsuya Kameyama, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 229 days.

(21) Appl. No.: 17/800,954

(22) PCT Filed: Feb. 24, 2021

(86) PCT No.: PCT/JP2021/006923
§ 371 (c)(1),
(2) Date: Aug. 19, 2022

(87) PCT Pub. No.: WO2021/172377
PCT Pub. Date: Sep. 2, 2021

(65) Prior Publication Data

US 2023/0072688 A1 Mar. 9, 2023

(30) Foreign Application Priority Data

Feb. 27, 2020 (JP) ..... 2020-031627

(51) Int. Cl.
*F28F 19/00* (2006.01)
*F28D 7/00* (2006.01)
*F28F 1/02* (2006.01)

(52) U.S. Cl.
CPC ..... *F28F 19/00* (2013.01); *F28D 7/0025* (2013.01); *F28F 1/022* (2013.01); *F28F 2265/00* (2013.01)

(58) Field of Classification Search
CPC .... F28F 19/00; F28F 7/02; F28F 1/022; F28F 9/02; F28F 2265/00; F28D 7/0025
See application file for complete search history.

(56) References Cited

U.S. PATENT DOCUMENTS

2004/0251013 A1 12/2004 Kawakubo et al.
2015/0266144 A1* 9/2015 Bengaouer ..... F28D 20/02 165/10

(Continued)

FOREIGN PATENT DOCUMENTS

JP 6-201287 A 7/1994
JP 7-180985 A 7/1995

(Continued)

OTHER PUBLICATIONS

International Preliminary Report on Patentability and Written Opinion of the International Searching Authority for International Application No. PCT/JP2021/006923, dated Sep. 9, 2022, with a English translation.
International Search Report for International Application No. PCT/JP2021/006923, dated May 11, 2021.

*Primary Examiner* — Henry T Crenshaw
*Assistant Examiner* — Kamran Tavakoldavani
(74) *Attorney, Agent, or Firm* — BIRCH, STEWART KOLASCH & BIRCH, LLP

(57) ABSTRACT

A heat exchanger core includes: a first passage row which is formed by a plurality of first passages; a plurality of first dividing walls separating the plurality of first passages from each other; a second passage row which is disposed adjacent to the first passage row and is formed by a plurality of second passages; a plurality of second dividing walls sepa- (Continued)

rating the plurality of second passages from each other; and a partition wall located between the first passage row and the second passage row, and separating the plurality of first passages and the plurality of second passages. (a) The partition wall has a greater section modulus in an orthogonal direction than either the first dividing wall or the second partition, or (b) a constituent material of the partition wall has a greater breaking strength than a constituent material of either the first dividing wall or the second dividing wall.

4 Claims, 8 Drawing Sheets

(56) References Cited

U.S. PATENT DOCUMENTS

| | | | | |
|---|---|---|---|---|
| 2017/0314792 | A1* | 11/2017 | Jindou | F28D 1/053 |
| 2018/0164052 | A1 | 6/2018 | Nakamura et al. | |
| 2020/0124362 | A1 | 4/2020 | Nakamura et al. | |

FOREIGN PATENT DOCUMENTS

| | | | |
|---|---|---|---|
| JP | 2004-347267 | A | 12/2004 |
| JP | 2005-180806 | A | 7/2005 |
| JP | 2009-228916 | A | 10/2009 |
| JP | 2014-70826 | A | 4/2014 |
| JP | 5645534 | B2 | 12/2014 |
| JP | 2017-36906 | A | 2/2017 |
| JP | 2021-38894 | A | 3/2021 |

* cited by examiner

HEAT EXCHANGER CORE

TECHNICAL FIELD

The present disclosure relates to a heat exchanger core.

The present application claims priority on Japanese Patent Application No. 2020-031627 filed on Feb. 27, 2020, the entire content of which is incorporated herein by reference.

BACKGROUND

Patent Document 1 discloses a heat exchanger using an aluminum extruded flat perforated pipe. In such heat exchanger, among internal partition wall portions existing between adjacent passages of a plurality of passages, an internal partition wall portion located at both ends of a flat shape in the longitudinal direction is thicker than the other internal partition wall portions.

CITATION LIST

Patent Literature

Patent Document 1: JP2017-36906A

SUMMARY

Technical Problem

Meanwhile, in a heat exchanger, a stress is generated by restraining heat elongation if the heat exchanger has a large temperature fluctuation, and a partition wall separating a plurality of first passages and a plurality of second passages may be damaged.

In view of the above, an object of at least one embodiment of the present disclosure is to provide a heat exchanger core capable of reducing the risk of damage to the partition wall separating the plurality of first passages and the plurality of second passages.

Solution to Problem

In order to achieve the above object, a heat exchanger core according to the present disclosure includes: a first passage row which is formed by a plurality of first passages arranged along a reference plane; a plurality of first dividing walls disposed so as to intersect the reference plane and separating the plurality of first passages from each other; a second passage row which is disposed adjacent to the first passage row in an orthogonal direction of the reference plane and is formed by a plurality of second passages arranged along the reference plane; a plurality of second dividing walls disposed so as to intersect the reference plane and separating the plurality of second passages from each other; and a partition wall located between the first passage row and the second passage row in the orthogonal direction of the reference plane, and separating the plurality of first passages and the plurality of second passages. (a) The partition wall has a greater section modulus in the orthogonal direction than either the first dividing wall or the second partition, or (b) a constituent material of the partition wall has a greater breaking strength than a constituent material of either the first dividing wall or the second dividing wall.

Advantageous Effects

With the heat exchanger core according to the present disclosure, (a) since the partition wall has the greater section modulus in the orthogonal direction of the reference plane than either the first dividing wall or the second dividing wall, the stress generated in the partition wall is smaller than the stress generated in either the first dividing wall or the second dividing wall, and either the first dividing wall or the second dividing wall is damaged preferentially over the partition wall. Thus, the stress generated in the partition wall is released, and the risk of damage to the partition wall is reduced (the risk of damage to the partition wall can be reduced). Further, (b) since the constituent material of the partition wall has the greater breaking strength than the constituent material of either the first dividing wall or the second dividing wall, either the first dividing wall or the second dividing wall is damaged preferentially over the partition wall. Thus, the stress generated in the partition wall is released, and the risk of damage to the partition wall is reduced (the risk of damage to the partition wall can be reduced).

DETAILED DESCRIPTION

Figure 1:
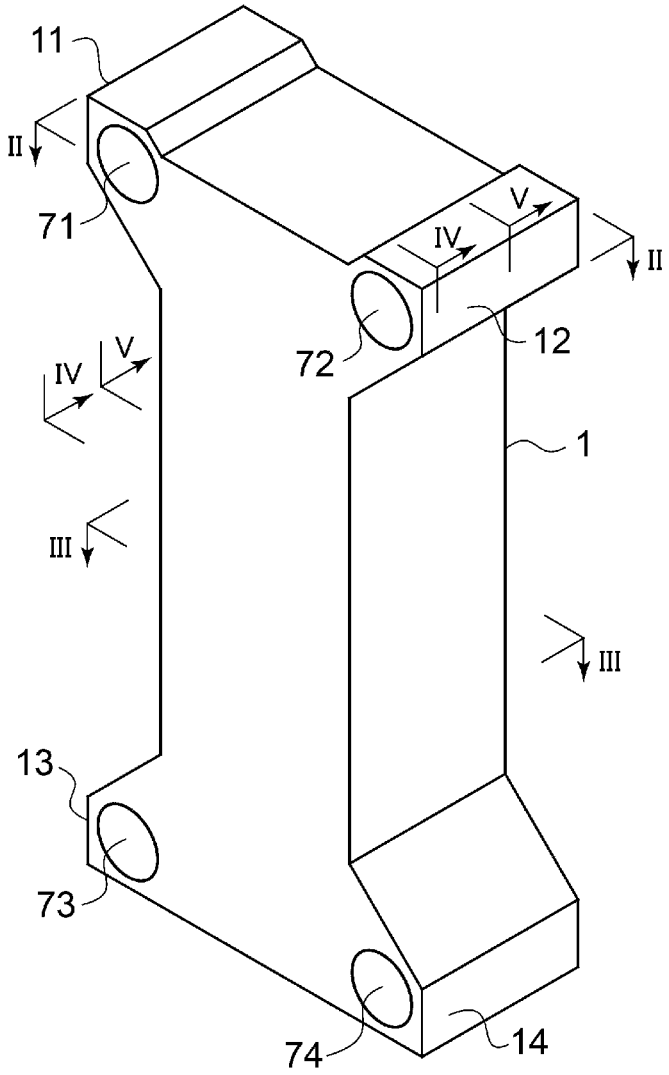
FIG. 1 is a view schematically showing a heat exchanger core according to at least one embodiment of the present disclosure.

Hereinafter, a heat exchanger core 1 according to the embodiment of the present disclosure will be described with reference to the accompanying drawings. It is intended, however, that unless particularly specified, dimensions, materials, shapes, relative positions and the like of components described in the embodiment or shown in the drawings shall be interpreted as illustrative only and not intended to limit the scope of the present invention.

[Heat Exchanger Core 1]

The heat exchanger core 1 according to the embodiment of the present disclosure is a component used alone or incorporated in a heat exchanger, and heat exchange is performed between a first fluid and a second fluid supplied to the heat exchanger core 1. The first fluid and the second fluid supplied to the heat exchanger core 1 may each be a liquid or a gas, but the temperatures of both are usually different. As shown in FIG. 1, for example, the heat exchanger core 1 can have a rectangular solid shape, but is not limited thereto.

Figure 2:
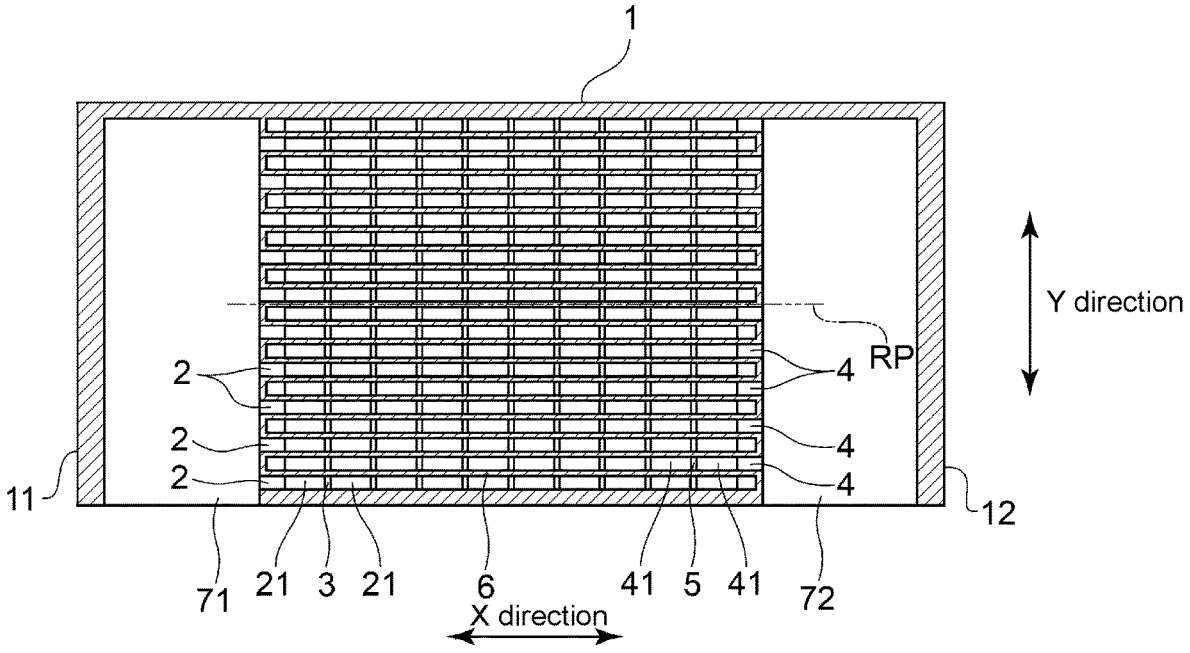
FIG. 2 is a cross-sectional view of the heat exchanger core shown in FIG. 1, taken along line II-II.
Figure 3:
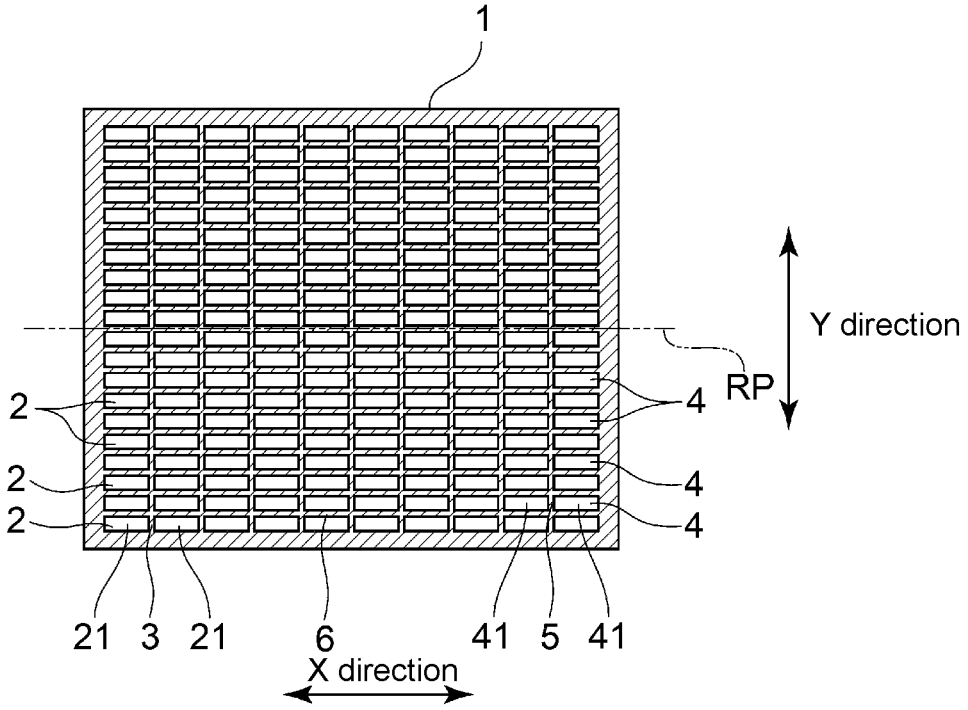
FIG. 3 is a cross-sectional view of the heat exchanger core shown in FIG. 1, taken along line III-III.

As shown in FIGS. 2 and 3, the heat exchanger core 1 according to the embodiment of the present disclosure includes a first passage row 2, a plurality of first dividing walls 3, a second passage row 4, and a plurality of second dividing walls 5, and partition walls 6.

As shown in FIG. 3, the first passage row 2 is formed by a plurality of first passages 21 arranged along a reference plane RP. For example, if there are the plurality of first passage rows 2 and, for example, the heat exchanger core 1 has the rectangular solid shape as shown in FIG. 1, the reference plane RP is set along the longitudinal direction of the rectangular solid, and the plurality of first passage rows 2 are set parallel to the reference plane RP.

Figure 4:
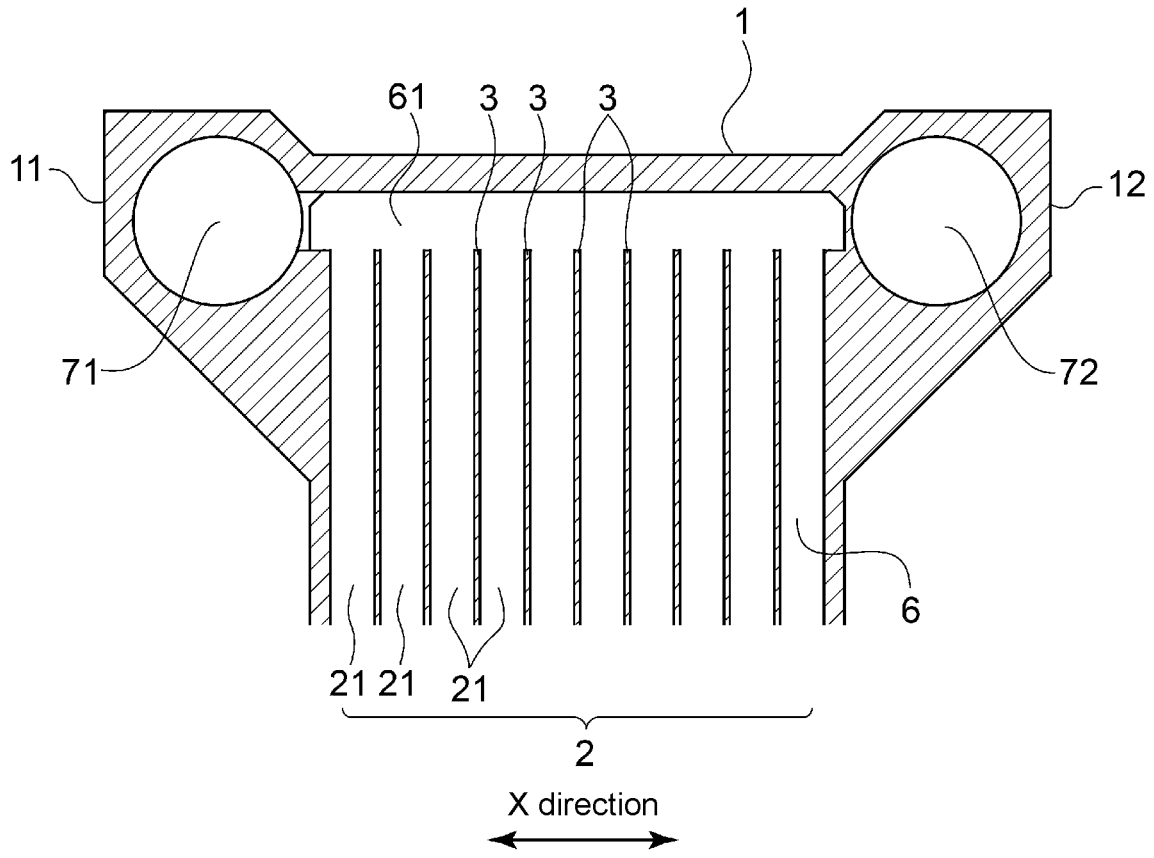
FIG. 4 is a cross-sectional view of the heat exchanger core shown in FIG. 1, taken along line IV-IV.

As shown in FIG. 4, the plurality of first dividing walls 3 are disposed so as to intersect the reference plane RP and separate the plurality of first passages 21 from each other. For example, the plurality of first dividing walls 3 are disposed parallel to each other and at equal intervals, and the plurality of first passages 21 are arranged in parallel and at equal intervals.

As shown in FIG. 3, the second passage row 4 is disposed adjacent to the first passage row 2 in the direction orthogonal to the reference plane RP, and is formed by a plurality of second passages 41 arranged along the reference plane RP. For example, if there are the plurality of second passage rows 4 and, for example, the heat exchanger core 1 has the rectangular solid shape as shown in FIG. 1, the plurality of second passage rows 4 are arranged alternating with the plurality of first passage rows 2 in the direction orthogonal to the reference plane RP (Y direction in FIG. 3).

Figure 5:
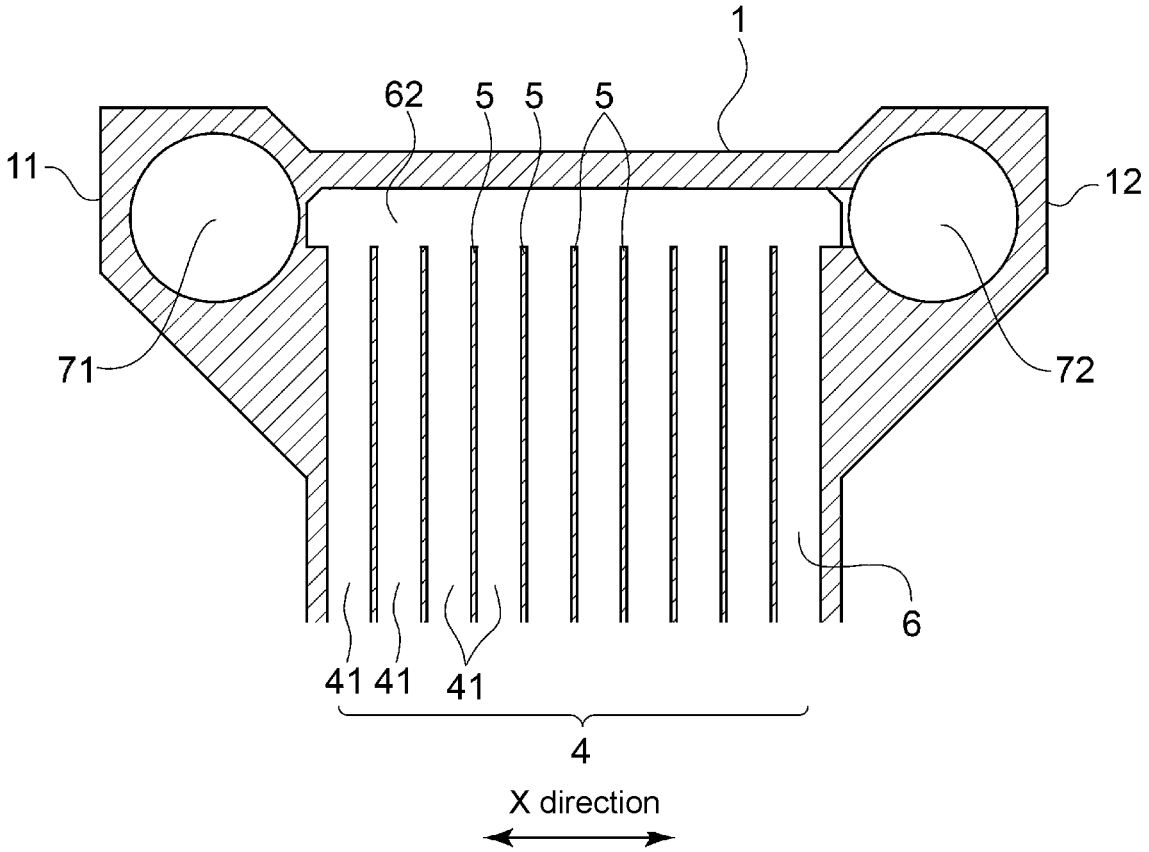
FIG. 5 is a cross-sectional view of the heat exchanger core shown in FIG. 1, taken along line V-V.

As shown in FIG. 5, the plurality of second dividing walls 5 are disposed so as to intersect the reference plane RP and separate the plurality of second passages 41 from each other. For example, the plurality of second dividing walls 5 are disposed parallel to each other and at the same intervals as the first dividing walls 3, and the plurality of second passages 41 are arranged in parallel and at the same intervals as the first passages 21. However, the present disclosure is not limited thereto.

As shown in FIG. 3, the partition walls 6 are located between the first passage row 2 and the second passage row 4 in the direction orthogonal to the reference plane RP, and separate the plurality of first passages 21 and the plurality of second passages 41. For example, if there are the plurality of partition walls 6 and, for example, the heat exchanger core 1 has the rectangular solid shape as shown in FIG. 1, the plurality of partition walls 6 are arranged in parallel and at equal intervals in the direction orthogonal to the reference plane RP (Y direction in FIG. 3).

As shown in FIGS. 4 and 5, if each of the plurality of first passage rows 2 is formed by the plurality of first passages 21 and each of the plurality of second passage rows 4 is formed by the plurality of second passages 41, intermediate passages are disposed at one end and another end of each of the plurality of first passage rows 2 and at one end and another end of each of the plurality of second passage rows 4, respectively. As shown in FIG. 4, an intermediate passage 61 (hereinafter, referred to as the "first intermediate passage 61") disposed at the one end (upper end) of each of the plurality of first passage rows 2 communicates with the plurality of first passages 21 at one end of the first passage 21 in an extension direction of the first passage 21. As shown in FIG. 5, an intermediate passage 62 (hereinafter, referred to as the "second intermediate passage 62") disposed at the one end (upper end) of each of the plurality of second passage rows 4 communicates with the plurality of second passages 41 at one end of the second passage 41 in an extension direction of the second passage 41. Although not shown, an intermediate passage (hereinafter, referred to as the "third intermediate passage") disposed at the another end (lower end) of each of the plurality of first passage rows 2 communicates with the plurality of first passages 21 at another end of the first passage 21 in the extension direction of the first passage 21. An intermediate passage (hereinafter, referred to as the "fourth intermediate passage") disposed at the another end (lower end) of each of the plurality of second passage rows 4 communicates with the plurality of second passages 41 at another end of the second passage 41 in the extension direction of the second passage 41.

As shown in FIGS. 4 and 5, each of the plurality of first intermediate passages 61 communicates with a first header passage 71, and each of the plurality of second intermediate passages 62 communicates with a second header passage 72. Further, each of the plurality of third intermediate passages communicates with a third header passage 73, and each of the plurality of fourth intermediate passages communicates with a fourth header passage 74.

As shown in FIG. 4, the first header passage 71 extends in a direction orthogonal to an extension direction of the plurality of first intermediate passages 61 at the one end (upper end) of each of the plurality of first passage rows 2, and communicates with the plurality of first passages 21 via the plurality of first intermediate passages 61. As shown in FIG. 5, the second header passage 72 extends in a direction orthogonal to an extension direction of the plurality of second intermediate passages 62 at the one end (upper end) of each of the plurality of second passage rows 4, and communicates with the plurality of second passages 41 via the plurality of second intermediate passages 62. Although not shown, the third header passage 73 extends in a direction orthogonal to an extension direction of the plurality of third intermediate passages at the another end (lower end) of each of the plurality of first passage rows 2, and communicates with the plurality of first passages 21 via the plurality of third intermediate passages. The fourth header passage 74 extends in a direction orthogonal to an extension direction of the plurality of fourth intermediate passages at the another end (lower end) of each of the plurality of second passage rows 4, and communicates with the plurality of second passages 41 via the plurality of fourth intermediate passages.

As shown in FIG. 1, if the heat exchanger core 1 has the rectangular solid shape, for example, the first header passage 71, the second header passage 72, the third header passage 73, and the fourth header passage 74 are located at the four corners of the rectangular solid on the same plane. In the heat exchanger core 1 where the first fluid and the second fluid flow in directions opposed to each other (hereinafter, referred to as the "heat exchanger core 1 of opposed flow"), the first header passage 71 serves as a passage for supplying the first fluid to the first passage 21, and the second header passage 72 serves as a passage for discharging the second fluid from the first passage 21. Further, the third header passage 73 serves as a passage for discharging the first fluid from the first passage 21, and the fourth header passage 74 serves as a passage for supplying the second fluid to the second passage 41. In the heat exchanger core 1 where the first fluid and the second fluid flow in the same direction (hereinafter, referred to as the "heat exchanger core 1 of parallel flow"), the second header passage 72 serves as a passage for supplying the second fluid to the second passage 41, and the fourth header passage 74 serves as a passage for discharging the second fluid from the second passage 41.

For example, the first header passage 71, the second header passage 72, the third header passage 73, and the fourth header passage 74 can be disposed outside the rectangular solid, but the present disclosure is not limited thereto. As shown in FIG. 1, for example, if the first header passage 71, the second header passage 72, the third header passage 73, and the fourth header passage 74 are disposed outside the rectangular solid, a first header 11, a second header 12, a third header 13, and a fourth header 14 are disposed so as to project outward in a width direction of the rectangular solid. Then, the first header 11, the second header 12, the third header 13, and the fourth header 14 are provided with the first header passage 71, the second header passage 72, the third header passage 73, and the fourth header passage 74, respectively.

[Section Modulus in Orthogonal Direction of Reference Plane RP]

Figure 6:
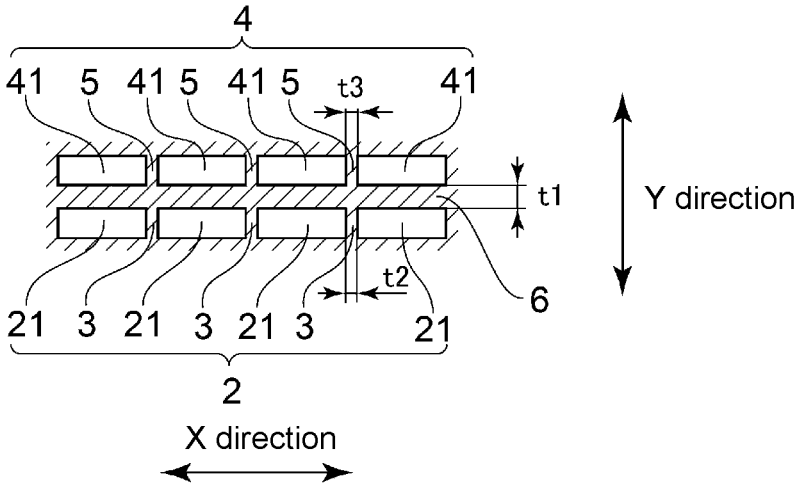
FIG. 6 is an enlarged view showing a passage cross section of the heat exchanger core shown in FIG. 3.

As shown in FIG. 6, the section modulus of the partition wall 6 in the orthogonal direction of the reference plane RP is greater than that of either the first dividing wall 3 or the second dividing wall 5. For example, the section modulus in the orthogonal direction of the reference plane RP is the same between the first dividing wall 3 and the second dividing wall 5, but may be different therebetween.

Figure 7:
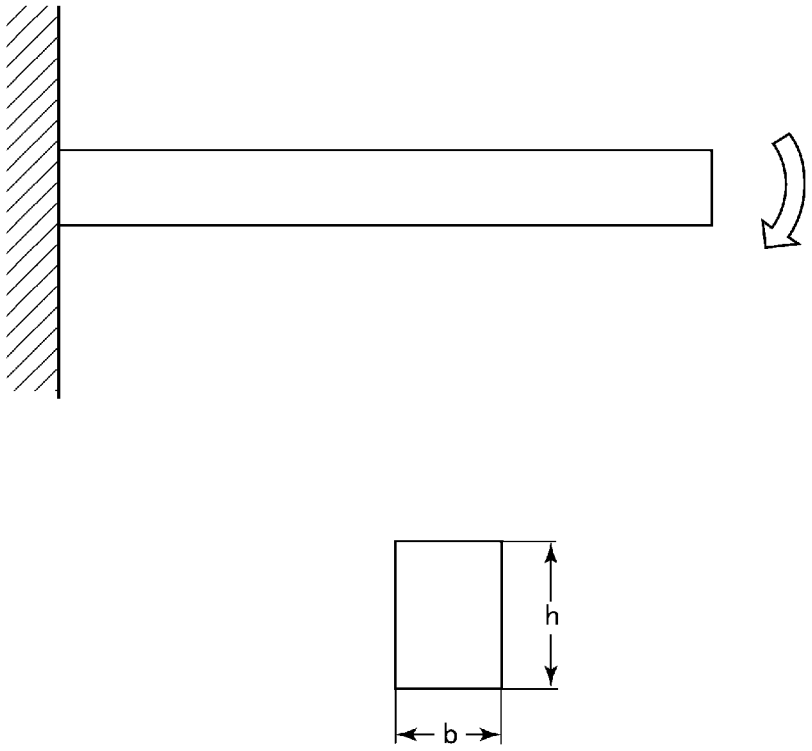
FIG. 7 is a view for describing the concept of rigidity against bending caused by thermal elongation.

In the rectangular cross section shown in FIG. 7, a moment of inertia of area $I_Z$ and a section modulus Z can be represented by:

$$I_z = \frac{bh^3}{12}$$

$$Z = \frac{bh^2}{6}$$

For example, the section modulus of the partition wall 6 is 0.5, and the section modulus Z of the first dividing wall 3 and the second dividing wall 5 is 0.04, where a thickness b of the partition wall 6 is 3, a height h thereof is 1, the thickness b of the first dividing wall 3 and the second dividing wall 5 is 0.4, and the height h thereof is 1. A stress generated in the partition wall 6 and a stress generated in the first dividing wall 3 or the second dividing wall 5 are inversely proportional to the section modulus Z, and the stress generated in the partition wall 6 is smaller than the stress generated in the first dividing wall 3 or the second dividing wall 5. Thus, even if the same weight is added, the stress generated in the partition wall 6 is smaller than the stress generated in the first dividing wall 3 or the second dividing wall 5. Consequently, the first dividing wall 3 or the second dividing wall 5 is damaged preferentially over the partition wall.

[Constituent Material]

The constituent material of the partition wall 6 has a greater breaking strength than the constituent material of either the first dividing wall 3 or the second dividing wall 5. For example, by using a constituent material, which has a lower brittleness than the partition wall 6, for either the first dividing wall 3 or the second dividing wall 5, the constituent material of the partition wall 6 has the greater breaking strength than the constituent material of either the first dividing wall 3 or the second dividing wall 5. Further, for example, by forming either the first dividing wall 3 or the second dividing wall 5 into a lattice structure, the constituent material of the partition wall may have the greater breaking strength than the constituent material of either the first dividing wall 3 or the second dividing wall 5. Further, for example, the constituent materials of the first dividing wall 3 and the second dividing wall 5 have the same breaking strength, but may have different breaking strengths.

With the heat exchanger core 1 according to the embodiment of the present disclosure described above, (a) since the partition wall 6 has the greater section modulus in the orthogonal direction of the reference plane RP than either the first dividing wall 3 or the second dividing wall 5, the stress generated in the partition wall 6 is smaller than the stress generated in either the first dividing wall 3 or the second dividing wall 5, and either the first dividing wall 3 or the second dividing wall 5 is damaged preferentially over the partition wall 6. Thus, the stress generated in the partition wall 6 is released, and the risk of damage to the partition wall 6 is reduced (the risk of damage to the partition wall 6 can be reduced). Further, (b) since the constituent material of the partition wall 6 has the greater breaking strength than the constituent material of either the first dividing wall 3 or the second dividing wall 5, either the first dividing wall 3 or the second dividing wall 5 is damaged preferentially over the partition wall 6. Thus, the stress generated in the partition wall 6 is released, and the risk of damage to the partition wall 6 is reduced (the risk of damage to the partition wall 6 can be reduced).

[Thickness of Partition Wall 6]

As shown in FIG. 6, in the heat exchanger core 1, the thickness of the wall (hereinafter, referred to as the "wall thickness") of the partition wall 6 is larger than that of either the first dividing wall 3 or the second dividing wall 5. Herein, the "wall thickness" refers to the thickness of the wall in the direction orthogonal to the extension direction of the first passage 21 and in FIG. 6, t1 represents a wall thickness of the partition wall 6, t2 represents a wall thickness of the first dividing wall 3, and t3 represents a wall thickness of the second dividing wall 5. The wall thickness t1 of the partition wall 6>the wall thickness t2 of the first dividing wall 3 or the wall thickness t2 of the partition wall 6>the wall thickness t3 of the second dividing wall 5, where t1 is the wall thickness of the partition wall 6, t2 is the wall thickness of the first dividing wall 3, and t3 is the wall thickness of the second dividing wall 5. The wall thickness t2 of the first dividing wall 3 and the wall thickness t3 of the second dividing wall 5 may be the same or different.

With such configuration, since the wall thickness is different between the partition wall 6 and the first dividing wall 3 or the second dividing wall 5, it is possible to realize the magnitude of the section modulus described above. Further, even if there is a pressure difference between the first fluid and the second fluid, since the wall thickness of the partition wall 6 is relatively large, it is possible to reduce the risk of damage to the partition wall 6 due to the pressure difference.

[Crack Origination Portion 31 (51)]

Figure 8:
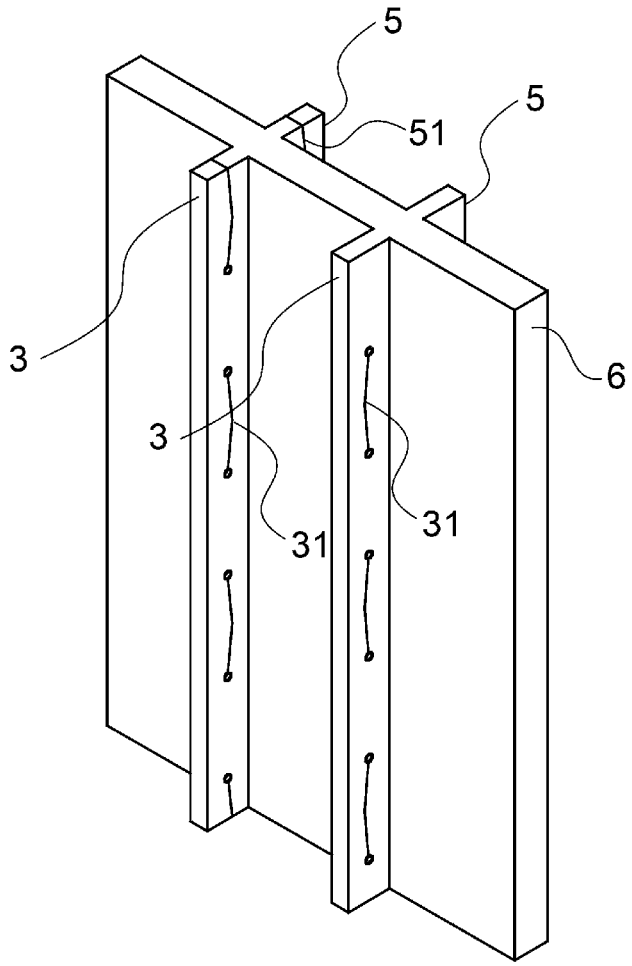
FIG. 8 is a view showing crack origination portions of a first dividing wall or a second dividing wall.

As shown in FIG. 8, in the heat exchanger core 1, either the first dividing wall 3 or the second dividing wall 5 includes a crack origination portion 31 (51). For example, the crack origination portion 31 (51) is a crack, a hole, a notch, a slit, or the like, and also includes a combination thereof. For example, the first dividing wall 3 includes the crack origination portion 31 in which a crack and a hole are combined, and the second dividing wall 5 includes the crack origination portion 51 constituted by a slit.

With such configuration, the partition wall 6 has the greater section modulus in the orthogonal direction of the reference plane RP than either the first dividing wall 3 or the second dividing wall 5 including the crack origination portion 31 (51). Thus, the stress generated in the partition wall 6 is smaller than the stress generated in either the first dividing wall 3 or the second dividing wall 5, and either the first dividing wall 3 or the second dividing wall 5 is damaged preferentially over the partition wall 6. For example, since a crack is generated from the crack origination portion 31 of the first dividing wall 3 or the crack origination portion 51 of the second dividing wall 5, either the first dividing wall 3 or the second dividing wall 5 is damaged prior to the partition wall 6.

[Communication of Passage]

As shown in FIG. 8, in the heat exchanger core 1, a pair of adjacent first passages 21 or second passages 41 communicate with each other via the crack origination portion 31 (51).

With such configuration, since the fluid moves in the pair of adjacent first passages 21 or second passage 41 via the crack origination portion 31 (51), it is possible to uniformize a pressure distribution in the pair of adjacent first passages 21 or second passages 41.

The present invention is not limited to the above-described embodiments, and also includes an embodiment obtained by modifying the above-described embodiments and an embodiment obtained by combining these embodiments as appropriate.

The contents described in the above embodiments would be understood as follows, for instance.

(1) A heat exchanger core 1 according to one aspect includes: a first passage row 2 which is formed by a plurality of first passages 21 arranged along a reference plane RP; a plurality of first dividing walls 3 disposed so as to intersect the reference plane RP and separating the plurality of first passages 21 from each other; a second passage row 4 which is disposed adjacent to the first passage row 2 in an orthogonal direction of the reference plane RP and is formed by a plurality of second passages 41 arranged along the reference plane RP; a plurality of second dividing walls 5 disposed so as to intersect the reference plane RP and separating the plurality of second passages 41 from each other; and a partition wall 6 located between the first passage row 2 and the second passage row 4 in the orthogonal direction of the reference plane RP, and separating the plurality of first passages 21 and the plurality of second passages 41. (a) The partition wall 6 has a greater section modulus in the orthogonal direction (=the magnitude relationship is the same, even if restated as the moment of inertia of area in the orthogonal direction) than either the first dividing wall 3 or the second dividing wall 5, or (b) a constituent material of the partition wall 6 has a greater breaking strength than a constituent material of either the first dividing wall 3 or the second dividing wall 5.

With the heat exchanger core 1 according to the present disclosure, (a) since the partition wall 6 has the greater section modulus in the orthogonal direction of the reference plane RP than either the first dividing wall 3 or the second dividing wall 5, the stress generated in the partition wall 6 is smaller than the stress generated in either the first dividing wall 3 or the second dividing wall 5, and either the first dividing wall 3 or the second dividing wall 5 is damaged preferentially over the partition wall 6. Thus, the stress generated in the partition wall 6 is released, and the risk of damage to the partition wall 6 is reduced (the risk of damage to the partition wall 6 can be reduced). Further, (b) since the constituent material of the partition wall 6 has the greater breaking strength than the constituent material of either the first dividing wall 3 or the second dividing wall 5, either the first dividing wall 3 or the second dividing wall 5 is damaged preferentially over the partition wall 6. Thus, the stress generated in the partition wall 6 is released, and the risk of damage to the partition wall 6 is reduced (the risk of damage to the partition wall 6 can be reduced).

(2) The heat exchanger core 1 according to another aspect is the heat exchanger core 1 as defined in (1), where the partition wall 6 has a larger thickness than either the first dividing wall 3 or the second dividing wall 5.

With such configuration, since the wall thickness is different between the partition wall 6 and the partition wall (the first dividing wall 3 or the second dividing wall 5), it is possible to realize the magnitude relationship of the section modulus described above in (a) of (1). Further, even if there is a pressure difference between the first fluid and the second fluid, since the wall thickness of the partition wall 6 is relatively large, it is possible to reduce the risk of damage to the partition wall 6 due to the pressure difference.

(3) The heat exchanger core 1 according to still another aspect is the heat exchanger core 1 as defined in (1) or (2), where either the first dividing wall 3 or the second dividing wall 5 includes a crack origination portion 31 (51).

For example, the crack origination portion 31 (51) is a crack, a hole, a notch, a slit, or the like, and also includes a combination thereof.

With such configuration, the partition wall 6 has the greater section modulus in the orthogonal direction of the reference plane RP than either the first dividing wall 3 or the second dividing wall 5 including the crack origination portion 31 (51). Thus, the stress generated in the partition wall 6 is smaller than the stress generated in either the first dividing wall 3 or the second dividing wall 5, and either the first dividing wall 3 or the second dividing wall 5 is damaged preferentially over the partition wall 6.

(4) The heat exchanger core 1 according to yet another aspect is the heat exchanger core 1 as defined in (3), where a pair of the adjacent first passages 21 or the adjacent second passages 41 communicate with each other via the crack origination portion 31 (51).

With such configuration, since the fluid moves in the pair of adjacent first passages 21 or second passage 41 via the crack origination portion, it is possible to uniformize a pressure distribution in the pair of adjacent first passages 21 or second passages 41.

REFERENCE SIGNS LIST

1 Heat exchanger core
11 First header
12 Second header
13 Third header
14 Fourth header
2 First passage row
21 First passage
3 First dividing wall
31 Crack origination portion
4 Second passage row
41 Second passage
5 Second dividing wall
51 Crack origination portion
6 Partition wall
61 First intermediate passage
62 Second intermediate passage
71 First header passage
72 Second header passage
73 Third header passage
74 Fourth header passage
RP Reference plane

The invention claimed is:

1. A heat exchanger core, comprising:

a first passage row which is formed by a plurality of first passages arranged along a reference plane;

a plurality of first dividing walls disposed so as to intersect the reference plane and separating the plurality of first passages from each other;

a second passage row which is disposed adjacent to the first passage row in an orthogonal direction of the reference plane and is formed by a plurality of second passages arranged along the reference plane;

a plurality of second dividing walls disposed so as to intersect the reference plane and separating the plurality of second passages from each other; and a partition wall located between the first passage row and the second passage row in the orthogonal direction of the reference plane, and separating the plurality of first passages and the plurality of second passages, wherein a constituent material of the partition wall has a greater breaking strength than a constituent material of either the first dividing wall or the second dividing wall.

2. The heat exchanger core according to claim 1, wherein the partition wall has a larger thickness than either the first dividing wall or the second dividing wall.

3. The heat exchanger core according to claim 1, wherein either the first dividing wall or the second dividing wall includes a crack origination portion.

4. The heat exchanger core according to claim 3, wherein a pair of the adjacent first passages or the adjacent second passages communicate with each other via the crack origination portion.

* * * * *